United States Patent [19]

Cooper et al.

[11] Patent Number: 4,490,195

[45] Date of Patent: Dec. 25, 1984

[54] EMULSION EXPLOSIVE COMPOSITION

[75] Inventors: John Cooper, Dundonald; David S. Reid, Kilwinning, both of Scotland; Colin A. Mumme-Young, Chester; Robert D. Gregson, Runcorn, both of England

[73] Assignee: Imperial Chemical Industries PLC, London, England

[21] Appl. No.: 540,854

[22] Filed: Oct. 11, 1983

[30] Foreign Application Priority Data

Oct. 22, 1982 [GB] United Kingdom ..... 8230224

[51] Int. Cl.[3] ..... C06B 45/00

[52] U.S. Cl. ..... 149/2; 149/21; 149/44; 149/45; 149/46; 149/61; 149/76; 149/83; 149/85; 149/92; 149/105; 149/110

[58] Field of Search ..... 149/2, 21, 44, 45, 46, 149/61, 76, 83, 85, 92, 105, 110

[56] References Cited

U.S. PATENT DOCUMENTS 4,294,633 10/1981 Clay ..... 149/60
4,343,663 8/1982 Breza ..... 149/4
4,357,184 11/1982 Binet et al. ..... 149/61

FOREIGN PATENT DOCUMENTS 991567 5/1965 United Kingdom .
1010186 11/1965 United Kingdom .
1306546 2/1973 United Kingdom .
1405348 9/1975 United Kingdom .
1423876 2/1976 United Kingdom .
1538092 1/1979 United Kingdom .
1557917 12/1979 United Kingdom .

*Primary Examiner*—Stephen J. Lechert, Jr.
*Attorney, Agent, or Firm*—Cushman, Darby & Cushman

[57] ABSTRACT

An emulsion explosive composition comprising an oxygen-supplying salt component as a discontinuous phase, an organic medium forming a continuous phase and a stabilizer which comprises a polycyclic hydrocarbon. Suitable stabilizers include sterols, such as cholesterol. The compositions, which may also include a conventional emulsifier, exhibit small diameter cap-sensitivity and improved storage characteristics.

9 Claims, No Drawings

EMULSION EXPLOSIVE COMPOSITION

This invention relates to an explosive composition and, in particular, to an emulsion explosive composition of the kind comprising a discontinuous oxidiser phase dispersed throughout a continuous fuel phase which is substantially immiscible with the discontinuous phase.

Commercially available emulsion explosive compositions generally comprise an external or continuous organic fuel phase in which discrete droplets of an aqueous solution of an oxygen-supplying source are dispersed as an internal or discontinuous phase. Such compositions are conventionally described as water-in-oil emulsion explosive compositions, and examples thereof have been described, inter alia, in U.S. Pat. Nos. 3,447,978, 3,674,578, 3,770,522, 4,104,092, 4,111,727, 4,149,916 and 4,149,917.

For certain applications the water content of the oxidiser phase of the emulsion explosive may be completely eliminated or at least reduced to a low level—for example, to less than 4% by weight of the total emulsion composition. Such compositions are conventionally referred to as melt-in-oil or melt-in-fuel emulsion explosives and have been described, inter alia, in U.S. Pat. No. 4,248,644.

Formation of an emulsion explosive composition is generally effected in the presence of a surface tension-modifying emulsifier selected to promote subdivision of the droplets of the oxidiser phase and dispersion thereof in the continuous phase. In addition, the emulsifier is believed to exist as a molecular coating layer on the surface of the droplets thereby to reduce incipient breakdown of the emulsion by inhibiting coalescence and agglomeration of the droplets.

The droplets of the oxidiser phase are inherently metastable and exhibit a tendency to crystallise. Growth of the resultant crystals tends to impair the sensitivity to detonation of the emulsion explosive compositions, and attendant interlocking of the crystal matrices renders the compositions solid and, therefore, difficult to prime. Conventional emulsion explosive compositions therefore generally exhibit a progressive deterioration of explosive performance resulting from the ageing process which occurs during the storage and or transporting period elapsing between manufacture and eventual use of the explosive.

Various attempts to modify the storage characteristics of emulsion explosive compositions have hitherto concentrated on the emulsifier component of the compositions and, in particular, on the selection of suitable emulsifiers, or blends thereof, which are designed to suppress coalescence of the supersaturated droplets of the oxidiser salt present in the discontinuous phase. However, such modified emulsion explosive compositions are often relatively insensitive to detonation (not cap sensitive—i.e. incapable of detonation by a detonator of magnitude less than a standard No. 8 detonator) and, as prepared, tend to have relatively large critical diameters (below which cartridges filled with the composition will not detonate)—for example, of the order of 19 mm. The modified compositions therefore tend to be reliably effective and of commercial utility as blasting agents only in cartridges having a relatively large diameter—for example, of at least 25 mm. Smaller critical diameter utility is usually achieved only by the inclusion in the compositions of a significant proportion of a eutectic-forming salt, such as calcium nitrate, which reduces the amount of gas generated on detonation and therefore adversely affects the explosive performance.

We have now devised a cap sensitive emulsion explosive composition exhibiting improved explosive performance and storage stability.

Accordingly, the present invention provides an emulsion explosive composition comprising an oxygen-supplying salt component as a discontinuous phase and an organic medium forming a continuous phase characterised in that the composition contains a stabiliser comprising a polycyclic hydrocarbon structure.

The invention further provides a process for producing an emulsion explosive composition comprising emulsifying an oxygen-supplying salt component and an organic medium to form an emulsion in which the salt forms at least part of the discontinuous phase and the organic medium forms at least part of the continuous phase characterised in that the composition contains a stabiliser comprising a polycyclic hydrocarbon structure.

The oxygen-supplying salt component of the discontinuous phase suitably comprises any oxidiser salt capable of releasing oxygen in an explosive environment in an amount and at a rate sufficient to confer acceptable explosive characteristics on the emulsion composition. Inorganic oxidiser salts conventionally employed in the production of emulsion explosive compositions, and suitable for inclusion in the compositions of the present invention, are disclosed, for example, in U.S. Pat. No. 3,447,978 and include ammonium salts and salts of the alkali- and alkaline-earth metals—such as the nitrate, chlorate and perchlorate salts, and mixtures thereof. Other suitable salts include hydrazine nitrate and urea perchlorate.

Ammonium nitrate is preferably employed as a primary oxidiser salt comprising at least 50% by weight of the oxygen-supplying salt component, supplemented, if desired, by a minor (not exceeding 50% by weight) amount of a secondary oxidiser component, such as calcium nitrate or sodium nitrate. A secondary oxidiser component may be incorporated into an aqueous discontinuous phase but its presence is particularly desirable if the oxygen-supplying salt component is to be incorporated into the emulsion in the form of a melt, i.e. in the substantial or complete absence of water from the discontinuous phase. Suitable secondary oxidiser components which form an eutectic melt when heated together with ammonium nitrate include inorganic oxidiser salts of the kind hereinbefore described, such as the nitrates of lead, silver, sodium and calcium, and organic compounds, such as mono- and poly-hydroxylic compounds including methanol, ethylene glycol, glycerol, mannitol, sorbitol and pentaerythritol, carbohydrates, such as glucose, sucrose, fructose and maltose, aliphatic carboxylic acids and their derivatives, such as formic acid and formamide, and organo-nitrogen compounds, such as urea, methylamine nitrate and hexamethylene tetramine, and mixtures thereof.

The discontinuous phase may optionally comprise a solid oxidiser component, such as solid ammonium nitrate conveniently in the form of prills. Furthermore, if desired, the discontinuous phase may additionally comprise a crystal growth-inhibitor—for example, of the kind described in our copending British patent application No. 8221038.

Typically, the discontinuous phase may comprise from about 20 to about 97%, more usually from 30 to 95%, and preferably from 70 to 95% by weight of the total emulsion explosive composition. The discontinuous phase may be entirely devoid of water, in the case of a melt emulsion, or may comprise relatively minor amounts of water, for example—from 2 to 30%, more usually from 4 to 25% and preferably from 8 to 18% by weight of the total composition.

The organic medium capable of forming the continuous phase of an emulsion explosive composition in accordance with the invention serves as a fuel for the explosive composition and should be substantially insoluble in the component(s) of the discontinuous phase with which it should be capable of forming an emulsion in the presence, if necessary, of an effective amount of an appropriate emulsifying agent. Ease of emulsification depends, inter alia, on the viscosity of the organic medium, and although the resultant emulsion may have a substantially solid continuous phase, the organic medium should be capable of existing initially in a sufficiently fluid state, if necessary in response to appropriate temperature adjustment, to permit emulsification to proceed.

Suitable organic media which are capable of existing in the liquid state at convenient emulsion formulation temperatures include saturated and unsaturated aliphatic and aromatic hydrocarbons, and mixtures thereof. Preferred media include refined (white) mineral oil, diesel oil, paraffin oil, petroleum distillates, benzene, toluene, dinitrotoluene, styrene, xylenes, and mixtures thereof.

In addition to the organic fuel medium the continuous phase may, optionally, comprise a wax to control the rheology of the system. Suitable waxes include petroleum, mineral, animal, and insect waxes. The preferred waxes have melting temperatures of at least 30° C. and are readily compatible with the formed emulsion. A preferred wax has a melting temperature in a range of from about 40° C. to 75° C.

Generally, the continuous phase (including wax(es), if present) comprises from 1 to 10, and preferably from 2 to 8% by weight of the total explosive composition, but higher proportions, for example in a range of from 1 up to 15 or even 20% may be tolerated.

A stabiliser for use in an emulsion explosive composition according to the invention comprises a polycyclic hydrocarbon structure.

Desirably, the stabiliser should, to some extent, function as a water(or melt)-in-oil emulsifier, to promote formation of the emulsion explosive composition, and preferably, therefore, comprises a lipophilic moiety, such as an aliphatic hydrocarbon chain, to ensure compatibility with the oily or organic medium of the continuous phase. The stabiliser preferably also comprises a hydrophilic moiety, such as a hydroxyl or phosphate group.

The stabiliser conveniently comprises a hydrocarbon the molecule of which contains from 26 to 40 carbon atoms, a preferred polycyclic stabiliser comprising a ring structure containing from 14 to 24, preferably from 14 to 18, carbon atoms, substituted in at least one position by an alkyl or alkylene hydrocarbon radical containing from 6 to 12 carbon atoms.

Suitable polycyclic stabilisers include those possessing the 17 carbon perhydro-1,2-cyclopentenophenanthrene ring system (I), and partially unsaturated and/or substituted variants thereof.

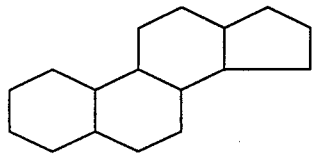

(I)

Examples of such polycyclic stabilisers include the $C_{27}$–$C_{29}$ alcohols known as sterols in which the alcoholic hydroxyl group is generally located at the 3 ($\beta$) position and an alkyl or alkylene substituent group of from 8 to 10 carbon atoms is generally located at the 17 position. In practice we have observed that for sterols with identical ring structures and longer ($C_9$–$C_{10}$) lipophilic side chains, more effective stabilisation is achieved when the side chain comprises an alkylene rather than an alkyl group.

A preferred sterol stabiliser comprises cholesterol (II), having a 17 carbon ring structure and an alkyl side chain of 8 carbon atoms.

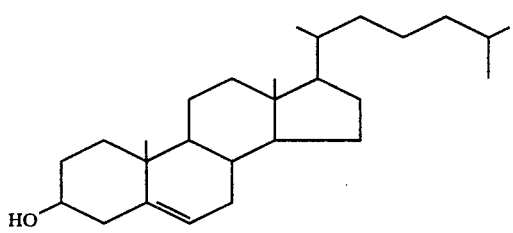

(II)

Other suitable sterol stabilisers include $\beta$-sitosterol (III), ergosterol (IV), 7-dehydrocholesterol (V), stigmasterol (VI) and lanosterol (VII).

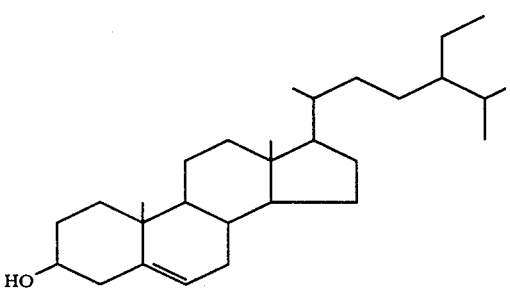

(III)

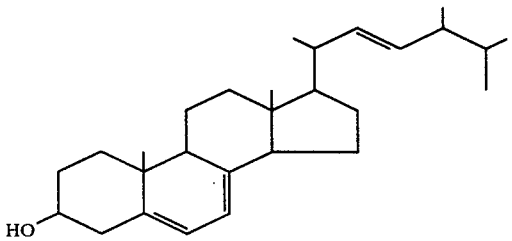

(IV)

-continued (V)

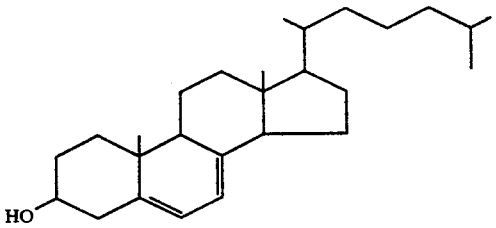

(VI)

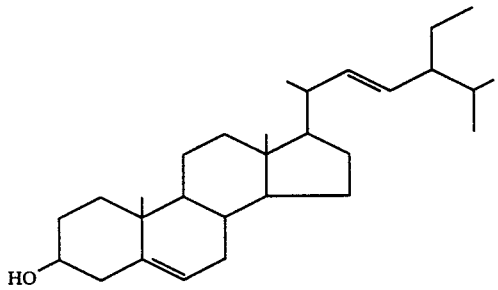

(VII)

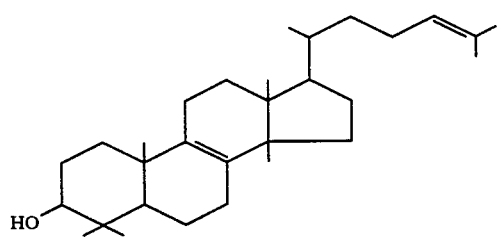

Lanolin, a naturally occurring wax-like material derived from wool-grease, has been observed to function effectively as a stabiliser in the emulsion explosive compositions of the invention. It is believed that the observed stabilisation depends on the presence in lanolin of constituent sterols, such as cholesterol and lanosterol.

If desired, mixtures of two or more polycylic hydrocarbon stabilisers may be employed in the compositions of the invention.

The stabiliser should be present in a stabilising amount in the emulsion explosive compositions of the invention. Generally, acceptable storage characteristics are achieved when the stabiliser comprises up to 10.0, especially from 0.01 to 2.5, preferably from 0.1 to 1.5, and particularly preferably from 0.2 to 1.0% by weight of the total explosive composition.

Formulation of a stable emulsion is generally effected in the presence of an emulsifier capable of promoting a relatively permanent dispersion of the discontinuous phase component(s) in the continuous phase medium.

Although a stabiliser, as herein described, functions to a degree as an emulsifier for the explosive composition, it is preferred that the composition additionally comprises a conventional emulsifier.

Accordingly, in a preferred embodiment of the invention, an emulsion explosive composition comprises a polycyclic hydrocarbon stabiliser and a conventional emulsifier.

Emulsifiers hitherto employed in the production of emulsion explosive compositions have conventionally been of the water(or melt)-in-oil type which promote or facilitate the formation of an emulsion in which the discontinuous phase comprises an aqueous (or melt) medium and the continuous phase comprises an oily or organic medium. Such emulsifiers are herein described as conventional emulsifiers.

Conventional emulsifiers, as hereinbefore defined, are strongly lipophilic, i.e. they exhibit a high affinity for the oily or organic medium of the continuous phase, and have a low hydrophilic-lipophilic balance (HLB). Typically, such conventional emulsifiers have HLB values of less than about 10.

Many suitable conventional emulsifiers have been described in detail in the literature and include, for example, sorbitan esters, such as sorbitan sesquioleate, sorbitan monooleate, sorbitan monopalmitate, sorbitan monostearate and sorbitan tristearate, the mono- and diglycerides of fat-forming fatty acids, soyabean lecithin, mixtures of higher molecular weight fatty alcohols and wax esters, ethoxylated fatty ethers, such as polyoxyethylene(4) lauryl ether, polyoxyethylene(2) oleyl ether, polyoxyethylene(2) stearyl ether, polyoxyalkylene oleyl laurate, and substituted oxazolines, such as 2-oleyl-4,4'-bis(hydroxymethyl)-2-oxazoline. Suitable mixtures of such conventional emulsifiers may also be selected for use.

Generally, acceptable emulsification characteristics are achieved when the emulsifier comprises from 0.1 to 5, preferably from 0.2 to 4, and particularly preferably from 0.5 to 2.5% by weight of the total explosive composition. Higher proportions of emulsifier may be tolerated, excess emulsifier serving as a supplemental fuel for the composition, but, in general, economic considerations dictate that the amount of emulsifier be kept to a minimum commensurate with acceptable performance.

Acceptable explosive performance and storage stability of the emulsion explosive composition are observed when the emulsifier, if employed, is present in a major amount relative to the stabiliser which is conveniently employed in a minor amount (<50 wt % of the total emulsifier and stabiliser concentration) relative to the emulsifier. Desirably, the weight ratio of conventional emulsifier to stabiliser in the explosive composition should be from 50:1 to 2:1, preferably from 20:1 to 3:1, and particularly preferably from 10:1 to 4:1.

Conventional oxidiser salts, such as ammonium nitrate, tend to crystallise in a needle habit, and it has been observed by optical microscopy that the stabilisers of the invention tend to inhibit such crystal growth. Modification of the habit of the growing crystals may also be effected, if desired, for example—by inclusion in the polycyclic stabiliser structure of a crystal habit modifying substituent(s), such as a phosphate group.

If desired, additional components may be incorporated into the compositions of the present invention. For example, supplementary fuel components may be included. Typical supplementary fuel components suitable for incorporation into the discontinuous phase include soluble carbohydrate materials, such as glucose, sucrose, fructose, maltose and molasses, lower glycols, formamide, urea, methylamine nitrate, hexamethylene tetramine, hexamethylene tetramine nitrate, and other organic nitrates.

Supplementary fuel components which may be incorporated into the continuous phase include fatty acids, higher alcohols, vegetable oils, aliphatic and aromatic nitro organic compounds, such as dinitrotoluene, nitrate esters, and solid particulate materials such as coal, graphite, carbon, sulphur, aluminium and magnesium.

Combinations of the hereinbefore described supplementary fuel components may be employed, if desired.

The amount of supplementary fuel component(s) employed may be varied in accordance with the required characteristics of the compositions, but, in general, will be in a range of from 0 to 30, preferably from 5 to 25, % by weight of the total emulsion explosive composition.

Thickening and or cross-linking agents may be included in the compositions, if desired—generally in small amounts up to the order of 10, and preferably from 1 to 5, % by weight of the total explosive composition. Typical thickening agents include natural gums, such as guar gum or derivatives thereof, and synthetic polymers, particularly those derived from acrylamide.

Minor amounts of non-volatile, water insoluble polymeric or elastomeric materials, such as natural rubber, synthetic rubber and polyisobutylene may be incorporated into the continuous phase. Suitable polymeric additives include butadiene-styrene, isoprene-isobutylene, or isobutylene-ethylene copolymers. Terpolymers thereof may also be employed to modify the continuous phase, and in particular to improve the retention of occluded gases in the compositions.

Preferably, the emulsion explosive compositions of the present invention comprise a discontinuous gaseous component to reduce their density (to less than 1.5, and preferably to from about 0.8 to about 1.4 gm/cc) and enhance their sensitivity. The gaseous component, usually air, may be incorporated into the compositions of the present invention as fine gas bubbles dispersed throughout the composition, hollow particles which are often referred to as microballoons or microspheres, porous particles, or mixtures thereof. A discontinuous phase of fine gas bubbles may be incorporated into the compositions of the present invention by mechanical agitation, injection or bubbling the gas through the composition, or by chemical generation of the gas in situ. Suitable chemicals for the in situ generation of gas bubbles include peroxides, such as hydrogen peroxide, nitrites, such as sodium nitrite, nitrosoamines, such as N,N'-dinitrosopentamethylenetetramine, alkali metal borohydrides, such as sodium borohydride, and carbonates, such as sodium carbonate. Preferred chemicals for the in situ generation of gas bubbles are nitrous acid and its salts which decompose under conditions of acid pH to produce gas bubbles. Thiourea may be used to accelerate the decomposition of a nitrite gassing agent. Suitable hollow particles include small hollow microspheres of glass and resinous materials, such as phenolformaldehyde and ureaformaldehyde. Suitable porous materials include expanded minerals, such as perlite.

The gas component is usually added during cooling such that the prepared emulsion comprises from about 0.05 to 50% by volume of gas at ambient temperature and pressure. Conveniently the occluded gas is of bubble diameter below 200 μm, preferably below 100 μm, more preferably between 20 and 90 μm and particularly between 40 and 70 μm, in proportions less than 50%, preferably between 40 and 3%, and particularly preferably between 30 and 10% by volume. Preferably at least 50% of the occluded gas will be in the form of bubbles or microspheres of 20 to 90 μm, preferably 40 to 70 μm internal diameter.

An emulsion explosive composition according to the present invention may be prepared by conventional emulsification techniques. Thus, the oxygen-supplying salt(s) may be dissolved in the aqueous phase at a temperature above the fudge point of the salt solution, preferably at a temperature in the range of from 25° to 110° C., and a mixture, preferably a solution, of the stabiliser, emulsifier (if employed) and organic phase is separately prepared, preferably at the same temperature as the salt solution. The aqueous phase is then added to the organic phase with rapid mixing to produce the emulsion explosive composition, mixing being continued until the formation is uniform. Optional solid and or gaseous components may then be introduced with further agitation until a homogeneous emulsion is obtained.

An emulsion explosive composition according to the invention may be used as such, or may be packaged into charges of appropriate dimensions.

The invention is illustrated by reference to the following Examples in which all parts and percentages are expressed on a weight basis unless otherwise stated.

EXAMPLE 1

This is a comparative Example, not according to the invention.

A mixture of ammonium nitrate (78.7 parts), and water (16.0 parts) was heated with stirring to a temperature of 75° C. to give an aqueous solution. The hot aqueous solution was added, with rapid stirring, to a solution of a conventional emulsifier, sorbitan sesquioleate (1.5 parts), in refined mineral oil (3.8 parts). Stirring was continued until a uniform emulsion was obtained. Glass microballoons (2.0 parts; grade B15/250 supplied by 3M) were added to the emulsion and thoroughly mixed therein. The composition was allowed to cool and was then packaged into conventional cylindrical paper cartridges of varying diameters. The composition, as prepared, was found to have a critical diameter of 8 mm. Cartridges of 25 mm diameter were stored at a temperature of 10° C. and were periodically tested for cap sensitivity using a standard No. 8 detonator.

After storage for 9 weeks the cartridges failed to detonate.

Optical microscopic examination of sample cartridges after storage for 9 weeks revealed evidence of ammonium nitrate crystal formation, the crystals being of needle habit, although some approximately spherical crystals and agglomerates were also detected.

EXAMPLE 2

The procedure of Example 1 was repeated, save that the sorbitan sesquioleate emulsifier concentration was reduced from 1.5 to 1.2 parts, and that cholesterol (0.3 part) was incorporated into the composition as a stabiliser.

The composition, as prepared had a critical diameter of 8 mm.

Cartridges of 25 mm diameter formed and tested in the manner of Example 1 were still cap sensitive after storage for 42 weeks at a temperature of 10° C. Identical cartridges stored under the same conditions for 45 weeks failed to detonate.

EXAMPLES 3 to 8

The procedure of Example 2 was repeated save that the emulsifier/stabiliser system employed in the various Examples respectively comprised sorbitan sesquioleate (1.2 parts) and 0.3 part of the stabiliser identified in the accompanying Table.

After storage at a temperature of 10° C., for the respective periods specified in the Table, the cartridges were still cap sensitive to a standard No. 8 detonator.

TABLE

| Example | Stabiliser (0.3 part) | Storage Period (weeks) |
|---|---|---|
| 3 | lanolin | 29 |
| 4 | ergosterol | 20 |
| 5 | 7-dehydro-cholesterol | 16 |
| 6 | stigmasterol | 16 |
| 7 | lanosterol | 13 |
| 8 | β-sitosterol | 9 |

EXAMPLE 9

An emulsion was prepared by emulsifying a solution of 78.7 parts of ammonium nitrate in 16 parts of water into an oil phase consisting of 3.8 parts of refined mineral, 1.2 parts of sorbitan sesquioleate and 0.3 parts of 'Amerchol' L101 (Mais Monda NV, Vilvoorde, Belgium) a multisterol extract containing cholesterol, agnosterol, lanosterol, 7-dehydrocholesterol, dihydrocholesterol and cerebrosterol. Glass microballoons (3 M B15/250, 2 parts) were thoroughly stirred into the emulsion. Cartridges of 25 mm diameter could be initiated by a No. 8 detonator as described in Example 1 after at least 15 weeks storage at 10° C.

EXAMPLE 10

An emulsion was prepared as in Example 9 except that the oil phase consisted of 5.3 parts of 'Argowax Distilled' (Westbrook Lanolin Company, Laisterdyke, Bradford; a lanolin alcohol mixture containing at least 30% cholesterol and also lanosterol, agnosterol and their dihydro derivatives together with straight and branched chain alcohols). This single ingredient (i.e. not containing sorbitan sesquioleate as a conventional emulsifier) acted as emulsifier, oil extender and rheology control agent. The resulting emulsion was non-tacky and suitable for cartridge formation by rolling onto a flat bed, cutting into strips and wrapping in paper.

Such cartridges had a storage life, measured as in Example 1, of at least 20 weeks at 10° C.

EXAMPLE 11

The procedure of Example 9 was repeated except that the oil phase consisted of a mixture of 'Argowax Distilled' (1.5 parts) and 'Slackwax' 431 (3.8 parts) (International Waxes, Agincourt, Ontario). The composition was almost non-tacky.

Cartridges of 25 mm diameter formed from the composition had a storage life at 10° C., measured as in Example 1, of greater than 20 weeks.

EXAMPLE 12

An emulsion was prepared as in Example 9 except that the aqueous phase consisted of 67.3 parts ammonium nitrate, 15 parts sodium nitrate and 12 parts of water, the oil phase was a mixture of 4.7 parts of refined mineral oil and 1 part of 'Argowax Distilled', and 2 parts of B15/20 glass microballoons were added to sensitize the explosive.

Cartridges of 25 mm diameter formed from the emulsion had a storage life, as measured in Example 1, of at least 20 weeks at 10° C.

We claim:

1. An emulsion explosive composition comprising an oxygen-supplying salt component as a discontinuous phase and an organic medium forming a continuous phase wherein the composition contains a stabilizer comprising a polycyclic hydrocarbon structure having a lipophilic moiety compatible with the organic medium.

2. A composition according to claim 1 wherein the stabiliser comprises a ring structure containing from 14 to 24 carbon atoms, substituted in at least one position by an alkyl or alkylene hydrocarbon radical containing from 6 to 12 carbon atoms.

3. A composition according to claim 1 wherein the stabiliser comprises a perhydro-1,2-cyclopentenophenanthrene ring structure.

4. A composition according to claim 1 wherein the stabiliser comprises a sterol.

5. A composition according to claim 4 wherein the sterol is cholesterol.

6. A composition according to claim 1 wherein the stabiliser comprises lanolin.

7. A composition according to claim 1 wherein the composition additionally comprises a conventional emulsifier.

8. A process for producing an emulsion explosive composition comprising emulsifying an oxygen-supplying salt component and an organic medium to form an emulsion in which the salt forms at least part of the discontinuous phase and the organic medium forms at least part of the continuous phase wherein the composition contains a stabilizer comprising a polycyclic hydrocarbon structure having a lipophilic moiety compatible with the organic medium.

9. An explosive charge wherein the charge comprises an emulsion explosive composition according to claim 1 or prepared by a process according to claim 8.

* * * * *